United States Patent [19]

Hanser

[11] Patent Number: 4,887,328

[45] Date of Patent: Dec. 19, 1989

[54] DEVICE FOR BRUSHING SEALING SURFACES OF ENCLOSURE ACCESS HOLES

[75] Inventor: Patrick E. L. Hanser, Yerres, France

[73] Assignee: Creation de Mecanismes, d'Automatismes et d'Asservissements, Epinay-sur-Orge, France

[21] Appl. No.: 163,348

[22] Filed: Mar. 2, 1988

[51] Int. Cl.[4] ..... A46B 13/02

[52] U.S. Cl. ..... 15/246.5; 15/21 E; 51/241 B

[58] Field of Search ..... 15/21 E, 21 R, 246, 15/246.5; 51/241 B

[56] References Cited

U.S. PATENT DOCUMENTS 3,922,748 12/1975 Ritz ..... 15/246.5

4,485,517 12/1984 Voigt ..... 15/246.5

*Primary Examiner*—Edward L. Roberts

*Attorney, Agent, or Firm*—Pollock, Vande Sande & Priddy

[57] ABSTRACT

A device for brushing the sealing plane of access holes in enclosures comprises an assembly which rotates about a main axis coaxial in use with the hole. On a mount at the end of this assembly is a brush eccentric to the main axis and which is rotated about an axis transversely disposed relative to the main axis. The device also comprises an arrangement for controlling the force with which the brush is applied to the sealing surface.

18 Claims, 6 Drawing Sheets

DEVICE FOR BRUSHING SEALING SURFACES OF ENCLOSURE ACCESS HOLES

BACKGROUND OF THE INVENTION

1. Field of the invention

The present invention concerns brushing devices.

To be more precise, the present invention concerns a brushing device designed for brushing the sealing plane of enclosure access holes, in particular but not exclusively of nuclear power station steam generators and pressurizers.

The present invention finds applications in brushing the sealing plane of manholes, viewing holes and hand access holes, these various openings differing from each other only in terms of their size.

2. Description of the Prior Art

The various brushing devices proposed until now are not entirely satisfactory.

A first object of the present invention is to propose a brushing device that functions entirely automatically, that is to say one that does not require any manual intervention after the brushing device is fitted to the enclosure.

Another object of the present invention is to propose a very lightweight brushing device.

Another object of the present invention is to propose a brushing device enabling the force exerted by the brushing means on the sealing plane to be controlled precisely.

Another object of the present invention is to propose a brushing device adapted to be fitted to the enclosure quickly and precisely.

SUMMARY OF THE INVENTION

The present invention consists in a brushing device for brushing the sealing plane of access holes in enclosures, comprising:

an assembly adapted to be rotated about a main axis coaxial in use with said hole, a mount at the end of said assembly, a brush on said mount eccentric to said main axis and adapted to be rotated about an axis transversely disposed relative to said main axis, and means for controlling the force with which said brush is applied to said sealing plane.

As will be explained hereinafter, the brushing device thus proposed in the context of the present invention procures movement of the brush over a ring-shaped surface coinciding with the surface of the sealing plane to be brushed and brushing of the sealing plane on circular lines concentric with the opening, eliminating any possibility of scoring of the sealing plane transversely to the axis of the opening.

Other characteristics and advantages of the present invention will emerge from the following detailed description given by way of non-limiting example only with reference to the appended drawings.

DESCRIPTION OF THE PREFERRED EMBODIMENT

In the remainder of the description the axis of rotation of the main assembly will be referred to as the main axis. This axis, which must coincide in use with the axis of the access hole whose sealing plane is to be brushed, is denoted A—A in the figures. The axis about which the brush rotates on itself will be called the secondary axis. This axis is referenced B—B in the figures. It is perpendicular to the main axis A—A.

Figure 1:
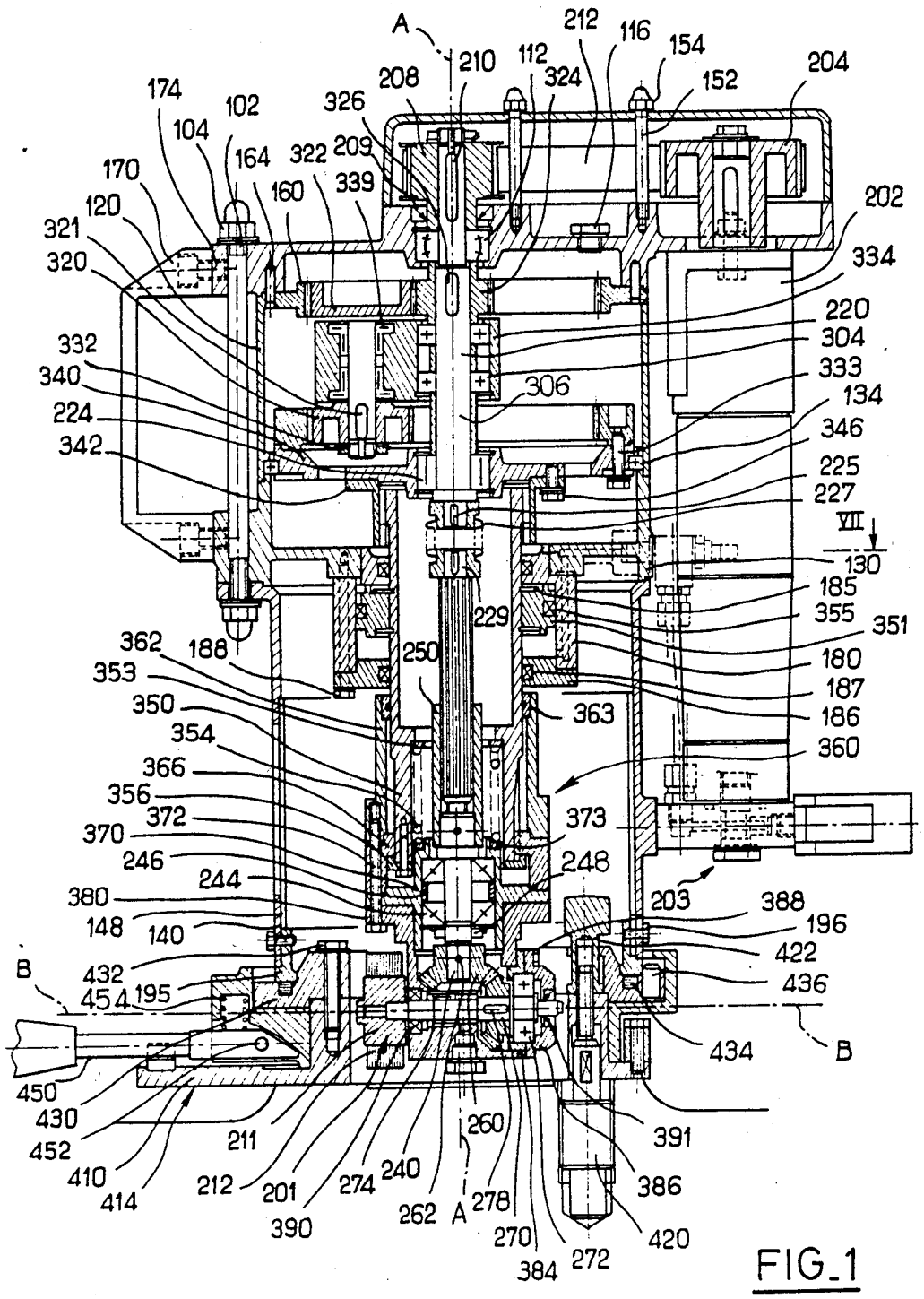
FIG. 1 shows a general schematic view of a brushing device in accordance with the present invention in longitudinal cross-section on a plane containing the axis of an enclosure access hole.

Finally, to simplify the following description the end of the brushing device which, in use, is adjacent to the sealing plane will be called the "front end". The front end of the brushing device is shown at the bottom in FIG. 1. Conversely, the end of the brushing device farthest away from the sealing plane will be called the "rear end" of the device. The rear end is shown at the top in FIG. 1.

Figure 2:
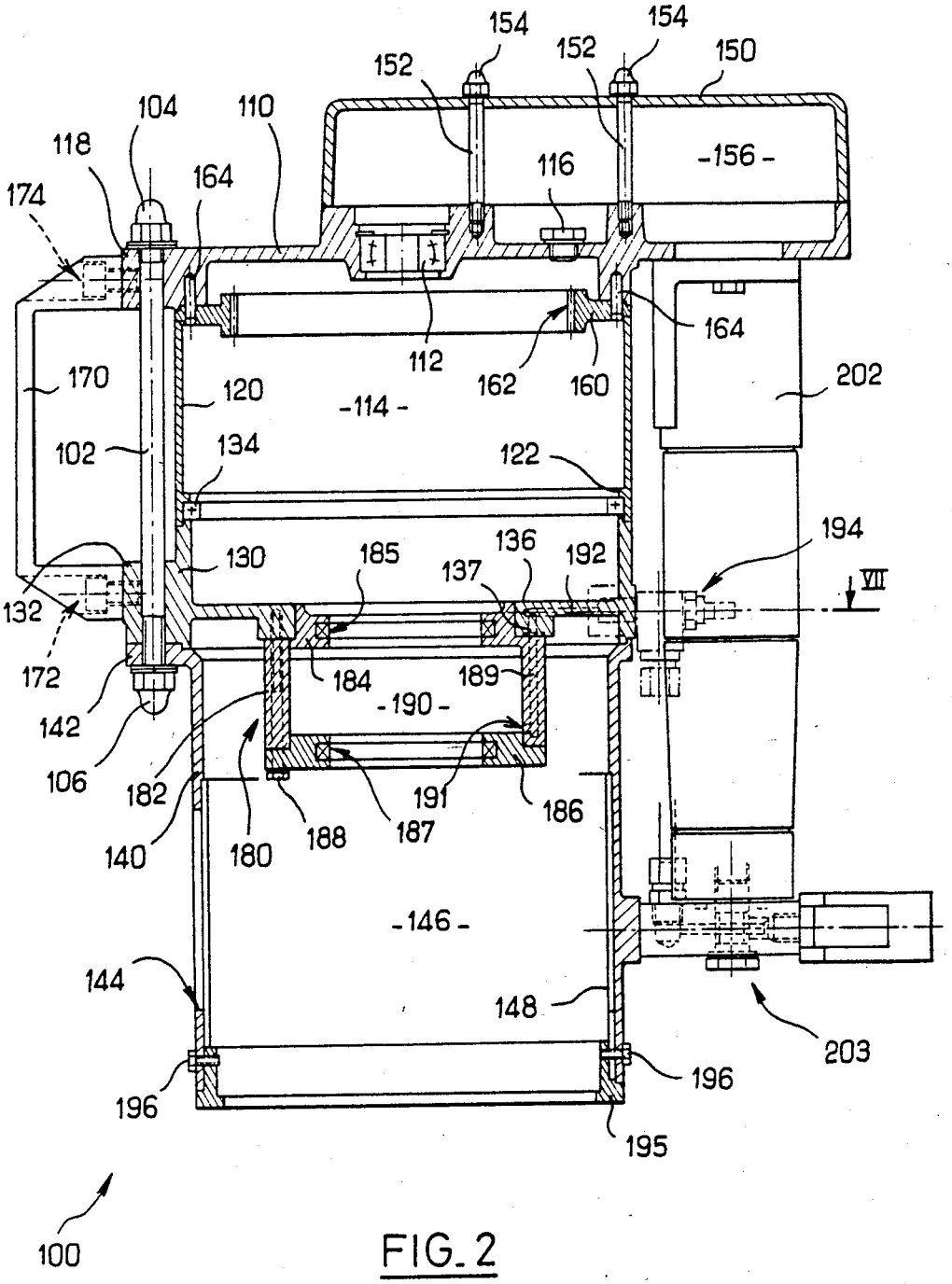
FIG. 2 shows in an identical view the structure of the casing of the brushing device in accordance with the present invention.
Figure 3:
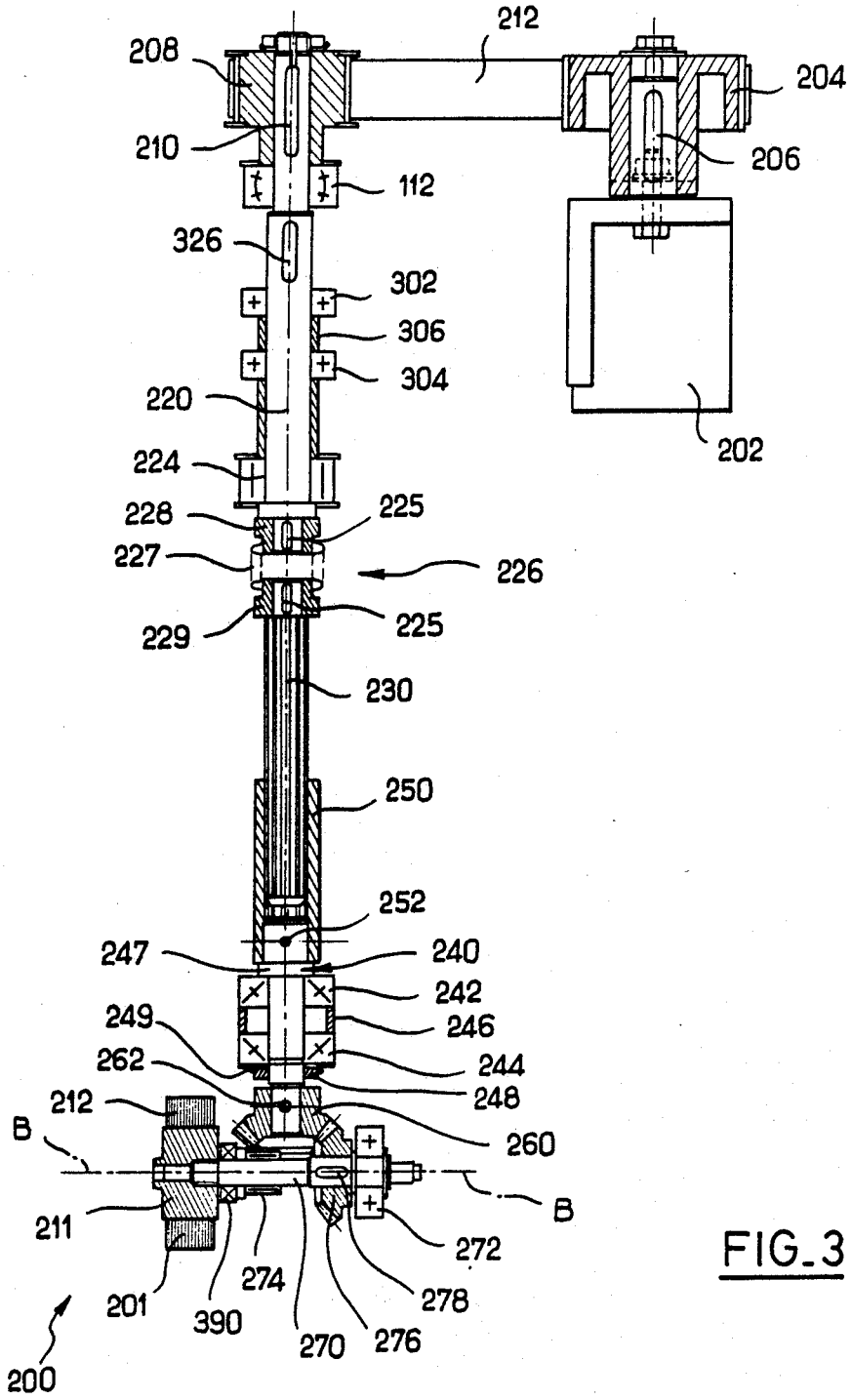
FIG. 3 shows in an identical view the drive means for rotating the brush.
Figure 4:
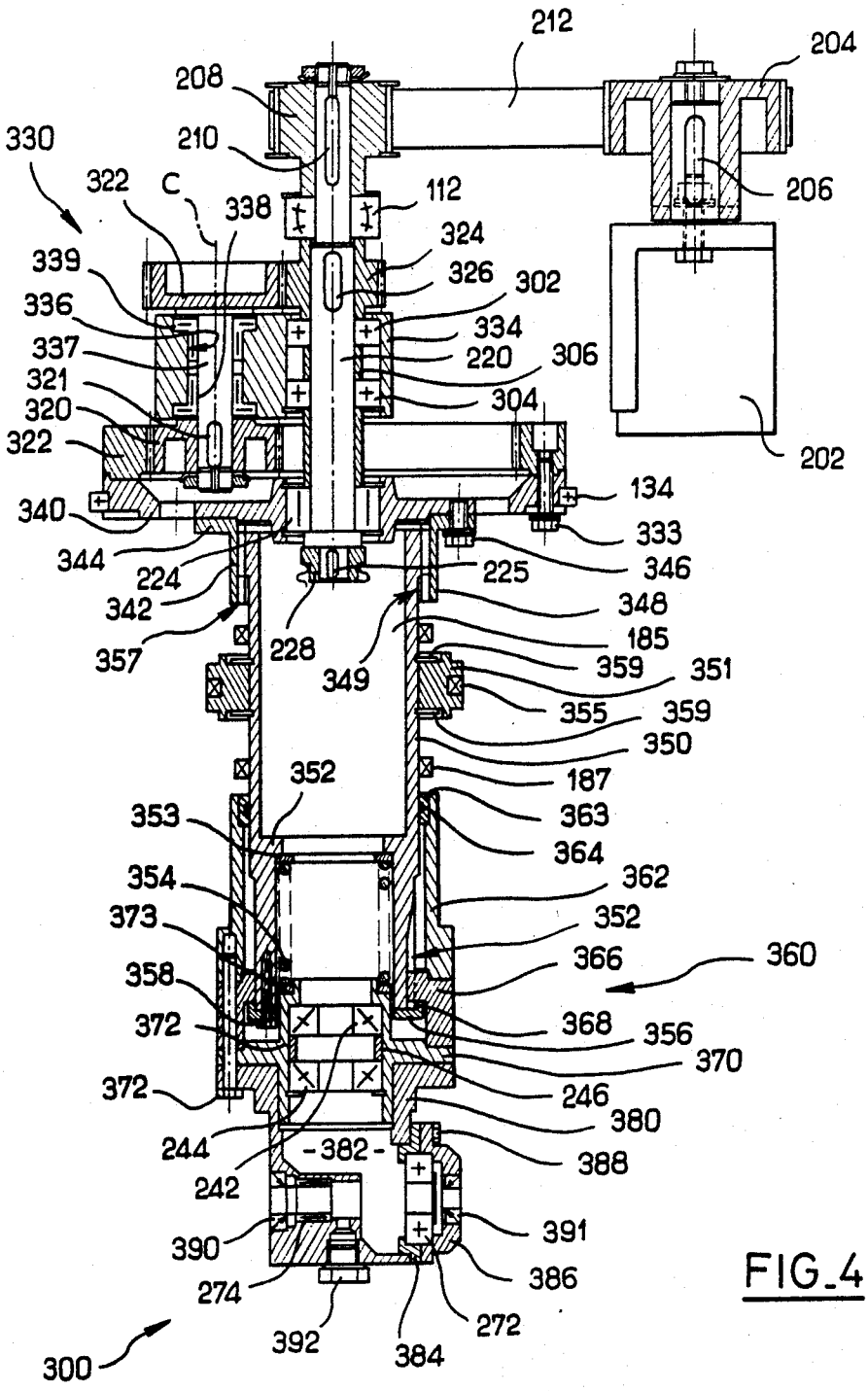
FIG. 4 shows in an identical view the drive means for rotating the assembly adapted to rotate about the main axis coaxial with the access hole.
Figure 5:
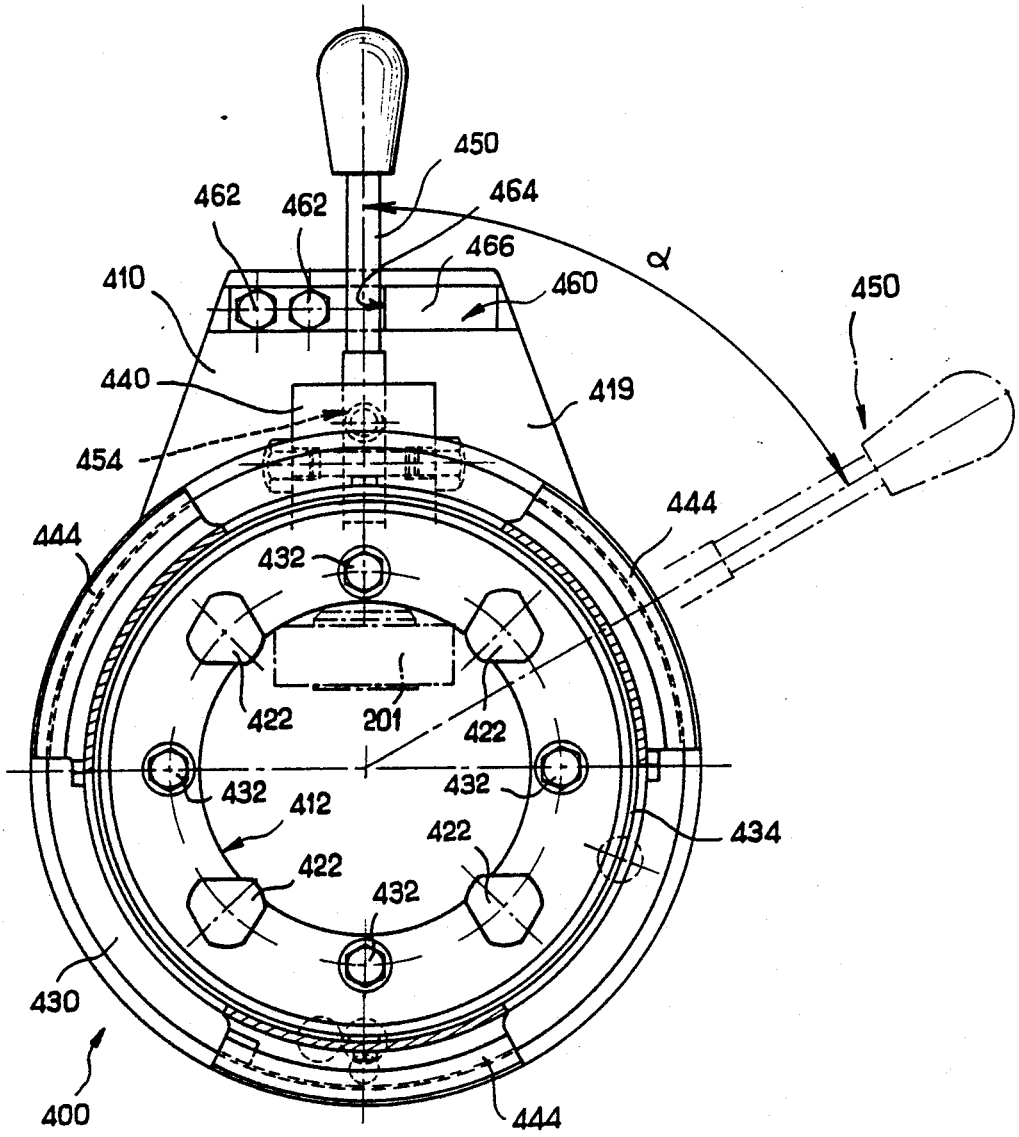
FIG. 5 shows a transverse schematic view perpendicular to the axis of the access hole of the means for fixing the casing of the brushing device to an enclosure.
Figure 6:
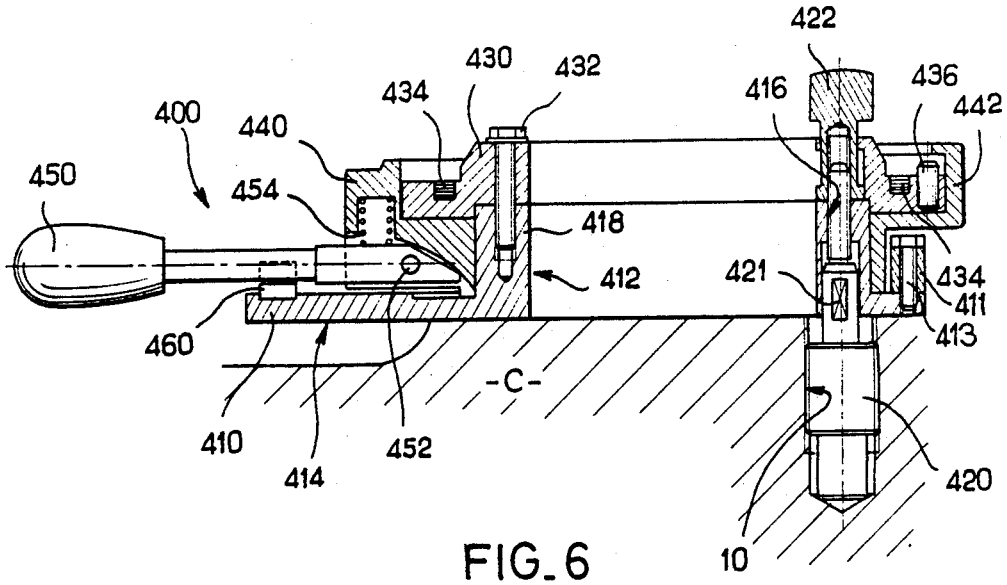
FIG. 6 shows these same fixing means in a view identical to that of FIG. 1.

Generally speaking, the brushing device in accordance with the present invention comprises a casing 100 shown in FIG. 2, drive means 200 for rotating the brush shown in FIG. 3, drive means 300 for rotating the main rotary assembly about the main axis A—A shown in FIG. 4 and means 400 shown in FIGS. 5 and 6 for fixing the casing of the brushing device to an enclosure.

There will now be described in succession the structure of the casing 100, that of the drive means 200 and 300 and that of the fixing means 400.

Structure of the Casing 100 Shown in FIG. 2

In its essentials, the casing 100 comprises a rear flange 110, a rear skirt 120, an intermediate flange 130 and a front skirt 140.

The rear skirt 120 and the front skirt 140 are formed by substantially cylindrical sleeves concentric with the main axis A—A.

The rear flange 110 closes off the rear end of the skirt 120. The intermediate flange 130 is inserted between the rear skirt 120 and the front skirt 140.

A housing 150 is carried by the rear surface of the flange 110. Studs 152 are screwed into the flange 110 and project from the latter towards the rear of the device. The housing 150 is immobilized on the flange 110 by means of nuts 154 threaded onto the studs 152.

The housing 150 defines with the flange 110 a chamber 156 accommodating toothed wheels 204, 208 and a notched belt 212 driving the brush 201.

The rear flange 110 has a bore though it accommodating a spherical roller bearing 112 coaxial with the main axis A—A.

The flange 110 defines with the rear skirt 120 and the intermediate flange 130 a chamber 114 adapted to receive an epicyclic gear train 330 for rotating the rotary assembly about the main axis A—A. A removable plug 116 carried by the flange 110 enables lubrication of the moving parts accommodated in the chamber 114.

A toothed ring 160 cooperating with the aforementioned epicyclic gear train 330 has its periphery inserted between the rear flange 110 and the rear skirt 120. The toothed ring 160 has internal teeth 162 centered on the main axis A—A.

To prevent any rotation of the toothed ring 160 about the main axis A—A relative to the casing 100, in particular relative to the flange 110 and to the rear skirt 120, pins 164 parallel to the main axis A—A are inserted into the rear flange 110 and into the toothed ring 160.

A handle 170 is fixed to the side of the casing. The handle 170 is fixed by means of screws 172, 174 to the rear flange 110 and to the intermediate flange 130, respectively.

The rear flange 110, the rear skirt 120, the intermediate flange 130 and the front skirt 140 are immobilized by tie-rods 102 and associated nuts 104, 106. The tie-rods 102 are parallel to the main axis A—A and pass through bores formed in bosses 118, 132, 142 on the periphery of the rear flange 110, the intermediate flange 130 and the front skirt 140, respectively. The aforementioned nuts 104, 106 are screwed onto the ends of the tie-rods 102 and bear against the bosses 118 and 142.

Moreover, the rear flange 110, the rear skirt 120 and the intermediate flange 130 are preferably bonded together at assembly time, using a cyanoacrylate adhesive, for example.

A bearing 134 concentric with the main axis A—A is supported on the inside surface of the rear skirt 120 where the latter merges with the intermediate flange 130. The bearing 134 is immobilized against movement in translation parallel to the main axis A—A by being gripped between a rib 122 integral with the internal surface of the rear skirt 120 and the rear radial surface of the flange 130.

The bearing 134 is designed to support in rotation an intermediate bearing plate of the rotary assembly.

The intermediate flange 130 has on the inside a ring-shaped plate 136 transverse to the main axis A—A and concentric with it.

The plate 136 supports an actuator body 180 on its front surface. In its essentials, the actuator body 180 is formed by a sleeve 182 concentric with the main axis A—A and at the rear, level with the plate 136, an annular rib 184.

The sleeve 182 of the actuator body carries at its front end a ring 186 transverse to and concentric with the main axis A—A, forming the back of the actuator. The ring 186 and the sleeve 182 are immobilized on the plate 136 by screws 188. These screw into the plate 136 and are parallel to the main axis A—A.

The rib 184 and the ring 186 are provided with respective bearing rings 185, 187 on their inside cylindrical surfaces. The bearing rings 185, 187 serve as a rotational support bearing for the rotary assembly.

In the thickness of the sleeve 182 are two channels parallel to the main axis A—A. One of these channels, denoted 189, is shown in FIG. 2.

These channels extend into the sleeve 182 from its rear end. The channels, such as the channel 189, open into the actuator chamber 190 defined by the body 182 through the intermediary of bores 191 radial to the main axis A—A and respectively near the rib 184 and the ring 186.

Also, at their rear end, the channels 189 open into blind channels 137, 138 formed in the plate 136 parallel to the main axis A—A and opening onto the front surface of the plate 136.

Figure 7:
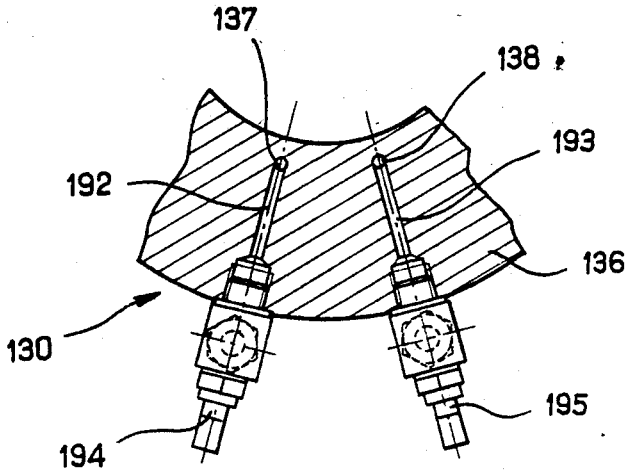
FIG. 7 shows a detail view of the brushing device on the cross-section plane denoted VII—VII in FIG. 1.

As shown in FIG. 7, the axial channels 137 and 138 respectively open into bores 192, 193 formed in the plate 136, in a radial direction relative to the main axis A—A, and opening onto the outside surface of the intermediate flange 130. Feed nozzles 194, 195 are screwed into the outside edge of the intermediate flange 130 and respectively communicate with the passages 192, 193.

The motor 202 is fixed to the outside of the casing, to be more precise to the rear flange 110 and the front skirt 140.

The figures show in a schematic way the supply means 203 of the motor 202, which is preferably a pneumatic motor.

The front skirt 140 is provided on its inside surface and at its front end with an annular flange 195. The annular flange 195 is fixed to the front skirt by means of screws 196 transverse to the main axis A—A.

The flange 195 is provided on its outside surface with projections substantially coplanar with the main axis A—A and covering limited angular sectors equi-angularly distributed around the main axis A—A. These projections are designed to cooperate with fixing means 400 shown in FIGS. 5 and 6 to immobilize the casing of the brushing device on an enclosure.

The front skirt 140 is preferably provided with a lateral opening 144 enabling the internal chamber 146 of the front skirt to be connected to a suction device adapted to suck out brushing residues. Where such suction is not required, the opening 144 may be closed off by a ring 148 disposed inside the front skirt 140.

Structure of the Drive Means 200 for Rotating the Brush

In the figures the brush to be driven is denoted 201.

This brush comprises an annular support body 211 carrying bristles 212 extending radially with respect to the rotation axis, the so-called secondary axis B—B.

The output shaft of the pneumatic motor 202, facing towards the rear and parallel to the main axis A—A, has an externally toothed drive pulley wheel 204 fixed to it by means of a key 206.

A shaft 220 is mounted to rotate coaxially with the main axis A—A in the casing. The shaft 220 is supported in rotation by the spherical roller bearing 112 housed in the rear flange 110 and by a needle roller bearing 224 housed in the intermediate bearing plate 340 which will be described in more detail later.

The shaft 220 carries at its rear end a take-up toothed pulley wheel 208. The take-up toothed pulley wheel 208 is immobilized in rotation on the shaft 220 by a key 210. A gasket 209 is inserted between the periphery of a cylindrical portion of the take-up toothed pulley wheel 208 and the rear flange 110.

A notched belt 212 provides a rotational coupling between the drive toothed pulley wheel 204 and the take-up toothed pulley wheel 208.

A longitudinally splined shaft 230 is placed in front of the shaft 220, substantially coaxial with it and coaxial with the main axis A—A.

The splined shaft 230 is connected to the shaft 220 by means of a flexible coupling 226, such as a metal bellows coupling.

A metal bellows coupling of this kind is formed by a bellows sleeve 227 fixed to two end pieces 228, 229. The end pieces 228 and 229 are respectively fixed to the shaft 220 and to the splined shaft 230 by keys 225, to rotate with them.

A shaft 240 placed in front of the splined shaft 230 is supported for rotation about the main axis A—A on the rotary assembly 300 by means of a pair of bearings 242, 244 separated by a cylindrical spacer 246.

The shaft 240 is immobilized against movement in translation on the rotary assembly 300, at the rear by a rib 247 and at the front by a nut 248 threaded onto a threaded portion of the shaft after a washer 249.

The shaft 240 is provided at its rear end with an internally splined sleeve 250. The splined shaft 230 is inserted into the sleeve 250.

The sleeve 250 is immobilized against rotation and movement in translation on the shaft 240 by means of a pin 252. The coupling between the splined shaft 230 and the sleeve 250 provides a rotational coupling between these two elements whilst enabling movement between them in translation parallel to the main axis A—A.

The shaft 240 carries at it front end a conical toothed wheel 260. The conical toothed wheel 260 is immobilized against rotation and movement in translation on the shaft 240 by means of a pin 262.

An auxiliary shaft 270 is supported to rotate about the secondary axis B—B perpendicular to the main axis A—A by the assembly 300. The auxiliary shaft 270 is supported to rotate about the axis B—B by a rigid bearing 272 and a needle roller bearing 274 supported by the assembly 300.

The body 211 of the brush 201 is screwed to the auxiliary shaft 270 in the direction opposite that in which the shaft 270 rotates about the secondary axis B—B.

A second conical toothed wheel 276 is constrained to rotate with the auxiliary shaft 270 by means of a key 278.

The second conical toothed wheel 276 meshes with the aforementioned conical toothed wheel 260.

The man skilled in the art will readily understand that the motor 202 serves to drive the drive toothed pulley wheel 204 and thence to secure, through the intermediary of the notched belt 212, rotation about the main axis A—A of the take-up toothed pulley wheel 208, the shaft 220, the flexible coupling 226, the splined shaft 230, the sleeve 250, the shaft 240 and the conical toothed wheel 260. Finally, the coupling between the two conical toothed wheels 260 and 276 rotates the auxiliary shaft 270 and therefore the brush 201 about the secondary axis B—B.

Structure of the Drive Means 300 for the Mobile Assembly

As shown in FIG. 4, the drive means 300 employ the aforementioned pneumatic motor 202 together with the drive toothed pulley wheel 204, the take-up toothed pulley wheel 208 and the notched belt 212.

Thus, in an advantageous way, the assembly is rotated about the main axis A—A and the brush is rotated about the secondary axis B—B by the same drive motor means.

The assembly comprises an intermediate bearing plate 340 rotationally mounted on the bearing 134 carried by the rear skirt 120. The intermediate bearing plate 340 is essentially formed by a ring-shaped plate transverse to the main axis A—A.

The intermediate bearing plate 340 carries the needle roller bearing 224 supporting the shaft 220.

The intermediate bearing plate 340 is immobilized against movement in translation parallel to the main axis A—A on the aforementioned bearing 134.

The assembly that rotates about the main axis A—A comprises at the front of the intermediate bearing plate 340 and in the direction from the rear towards the front a hollow shaft 350 and then a casing 360.

The casing 360 is formed by assembling various elements. To be more precise, the casing 360 comprises in the direction from the rear towards the front, generally concentric with the main axis A—A, a centering ring 362, an intermediate member 366, a support member 370 and a housing 380.

The centering ring 362, the intermediate member 366, the support member 370 and the housing 380 are assembled together by means of screws 372 parallel to the main axis A—A.

The centering ring supports at its rear end a guide ring 363 fitted with an O-ring seal 364 which lies against the cylindrical outside surface of the hollow shaft 350.

The front end of the hollow shaft 350 is provided on its outside surface with longitudinal splines parallel to the main axis A—A as schematically represented at 352.

The intermediate part 366 is provided with plurality of teeth 368 projecting from its inside surface and meshing with the splines 352.

The meshing of the teeth 368 and the splines 352 provides a rotational coupling between the hollow shaft 350 and the casing 360 but enables relative movement in translation between them parallel to the main axis A—A.

The support member 370 is provided with an internal cylinder 372 which supports the bearings 242, 244 and the cylindrical spacer 246.

The housing 380 defines a chamber 382 which houses the front end of the shaft 240, the conical toothed wheel 260, the shaft 270 and the second conical toothed wheel 276.

The housing 380 also carries inside the housing 382 the needle roller bearing 274 and the bearing 272. To be more precise, the bearing 272 is carried by a bearing plate 384 coaxial with the secondary axis B—B fixed to the casing 380 at the end opposite the brush 201. The bearing 272 is immobilized on the bearing plate 384 by means of a cover 386 which also closes the housing 380.

The cover 386 and the bearing plate 384 are immobilized on the housing 380 by means of screws 388.

The housing 380 supports on the same side as the brush 201 a gasket 390 resting against the shaft 270 carrying the brush.

In a similar way, the cover 386 supports a gasket 391 resting against the support shaft 270.

A removable plug 392 carried by the housing 380 is used to lubricate the shaft 270 in the housing 380.

The rear end of the sleeve 372 attached to the support member 370 enters inside the front end of the hollow shaft 350.

This has substantially halfway along it a rib 352 projecting from its inside surface.

A helical spring 354 is disposed between the rib 352 and the rear transverse surface of the sleeve 372 fastened to the support member 370.

To be more precise, washers 353 and 373 are disposed between the rear and front ends of the springs 354 and the rib 352 and the sleeve 372, respectively.

Thus the spring 354 urges the casing 360 towards the front relative to the hollow shaft 350.

However, movement of the casing 360 towards the front relative to the hollow shaft 350 is limited by an abutment washer 356 fixed to the front transverse surface of the hollow shaft 350 by means of screws 358. The abutment washer 356 serves as a forward abutment for the teeth 368 provided on the intermediate member 366.

The gaskets 185, 187 respectively housed in the rib 184 and in the ring 186 rest against the cylindrical outside surface of the hollow shaft 350.

Also, the hollow shaft 350 is provided on its outside surface and between the two gaskets 185, 187 previously mentioned with an annular member 351 forming a piston designed to be accommodated in the chamber 190 defined by the actuator body 180. The radial thickness of the piston 351, relative to the main axis A—A, corresponds substantially to the radial depth of the chamber 190 relative to the same axis.

The piston 351 is provided on its outside surface with a gasket 355 resting against the inside surface of the sleeve 182.

The piston 351 is immobilized against movement in translation on the hollow shaft 350 parallel to the main axis A—A by means of two circlips 359.

The hollow shaft 350 is coupled in rotation to the intermediate bearing plate 340 but is able to move in translation relative to it parallel to the main axis A—A.

To this end the rear end of the hollow shaft 350 is provided with splines 357 on its outside surface.

Also, a dog clutch type gear 342 is fixed to the front surface of the intermediate bearing plate and cooperates with the teeth 357.

The gear 342 comprises a plate 344 transverse to the main axis A—A and fixed to the intermediate bearing plate 340 by screws 346 and a sleeve 348 comprising on its inside surface splines 349 which mesh with the teeth 357.

As already indicated, the hollow shaft and therefore the casing 360 are coupled in rotation to the intermediate bearing plate 340. On the other hand, the hollow shaft 350 can slide parallel to the main axis A—A relative to the intermediate bearing plate 340.

The hollow shaft is moved parallel to the main axis A—A by selectively directing a fluid under pressure to one or other of the nozzles 194, 195, that is to say to one side or the other of the piston 351.

An internally toothed ring 332 centered on the main axis A—A is fixed to the rear surface of the intermediate bearing plate 340 by means of screws 333.

The shaft 220 also carries, substantially halfway along its length, a pair of bearings 302, 304 separated by a cylindrical spacer 306.

A planet wheel support member 334 is mounted to rotate about the main axis A—A on the shaft 220 by means of bearings 302, 304.

A bore 336 through the support member 334 has its axis C—C parallel to and spaced from the main axis A—A.

A shaft 337 is mounted to rotate in the bore 336 about the axis C—C. The shaft 337 is guided in rotation about the axis C—C by needle roller bearings 338, 339.

An externally toothed wheel 320 is constrained to rotate with the front end of the shaft 337 by means of a key 321. The toothed wheel 320 meshes with the toothed ring 322.

Another externally toothed wheel 322 is fixed to the rear end of the shaft 337.

This toothed wheel 322 meshes with an externally toothed wheel 324 fixed to the shaft 220 between the bearing 302 and the bearing 112 by means of a key 326.

The man skilled in the art will readily understand that the pneumatic motor 202 rotates the drive toothed pulley wheel 204 and, through the intermediary of the notched belt 212, the take-up toothed pulley wheel 208, the shaft 220 and the toothed wheel 324 about the main axis A—A.

The toothed wheel 324 rotates the driven planet wheel 322 on the ring 160, the shaft 337 and the driving planet wheel 328 about the axis C—C. The driving planet wheel 320 rotates the toothed ring 322 at reduced speed and thence the intermediate bearing plate 340, the gear 342, the hollow shaft 350 and the casing 360.

Structure of the Means for Fixing the Casing of the Brushing Device to an Enclosure The fixing means 400 shown in FIGS. 5 and 6 comprise a centering flange 410. The centering flange 410 has an internal bore 412 by means of which the brush 201 has access to the sealing plane to be brushed.

The centering flange 410 rests in use with its front surface 414 against the enclosure, at the outside periphery of the sealing plane to be brushed.

The centering flange 410 is fixed to the enclosure by means of a plurality of studs 420 and clamping nuts 422.

The shanks of the studs 420 pass through bores 416 formed in the flange 410. The bores 416 are equi-angularly distributed about the bore 412. The bores 416 are parallel to the axis A—A.

To fit the centering flange 410 to the enclosure, it is first necessary to screw the studs 420 into the threaded bores 10 provided in the enclosure C outside the sealing plane to be brushed. The flange 410 is then positioned on the enclosures C, the shanks of the studs 420 passing through the bores 416. Finally, the clamping nuts 422 are screwed on to the shanks of the studs 420, until they bear against the rear surface of the clamping flange 410.

The bores 416 previously mentioned are formed in a tubular part 418 of the centering flange 410 coaxial with the access hole in the enclosure and projecting towards the rear.

An auxiliary flange 430 is carried by the rear surface of the tubular part 418. The auxiliary flange is fixed to the rear surface of this tubular part 418 by screws 432. The auxiliary flange 430 projects radially outwards in line with the axis of the access hole in the enclosure relative to the tubular part 418.

The auxiliary flange 430 is provided on its rear surface with an annular groove accommodating a gasket 434 against which the transverse front surface of the flange 195 attached to the front skirt 140 rests in use.

The auxiliary flange 430 preferably supports a cylindrical rod 436 parallel to the axis of the access hole in the enclosure and projecting from the rear surface of the auxiliary flange 430. The cylindrical rod 436 serves as a polarizer.

A collar 440 is supported to rotate between the rear surface of the centering flange 410 and the front surface of the auxiliary flange 430.

The collar 440 is provided with a substantially cylindrical rim 442 facing towards the rear and surrounding the auxiliary flange 430.

The cylindrical rim 442 is provided at its rear end with a plurality of protections 444 directed inwardly, that is to say towards the axis of the access hole in the enclosure. The projections 444 each cover a limited angular sector complementary to that defined by the projections provided on the outside periphery of the flange 195 attached to the front skirt 180.

The projections 444 are equi-angularly distributed about the axis of the access hole in the enclosure.

The projections 444 provided on the collar 440 are preferably provided on their front surface, and in a position adjacent their engagement edges, with a surface inclined towards the rear as it approaches the insertion edge on the projections attached to the flange 195, to facilitate engagement of the projections 444 with those on the flange 195.

The man skilled in the art will readily understand that rotating the collar 440 about the axis of the access hole to place the projections 444 behind the projections on the flange 195 makes it possible to immobilize the casing of the brushing device on the fixing means 400 bayonet coupling fashion.

The collar 440 is rotated about the axis of the hole by a lever 450.

The latter is substantially radial relative to the axis of the bore 412.

To be more precise, the lever 450 is mounted to rotate on the collar 440 by means of a pin 452 the axis of which is parallel to the bearing surface 414 of the centering flange 410 and perpendicular to a radius passing through the axis of the access hole in the enclosure.

A spring 454 disposed between the collar 440 and the lever 450 urges the latter towards the front, towards the centering flange 410.

The latter has an eccentric part 419 which carries a cam 460.

The cam 460 is fixed to the centering flange 410 by means of screws 462.

The cam 460 defines an abutment surface 464 substantially perpendicular to the bearing surface 414 and radial relative to the axis of the access hole in the enclosure. The cam 460 further defines a rear cam surface 466 running from the abutment surface 464 and inclined towards the front in the direction away from the abutment surface 464, that is to say converging towards the bearing surface 414 of the centering flange in the direction away from the abutment surface 464.

The procedure for fixing the brushing device to an enclosure is as follows.

Firstly, the centering flange 410, the auxiliary flange 430 and the collar 440 rotationally mounted on these elements are fixed to the enclosure C by means of the studs 420 and the clamping nuts 422.

The lever 450 is then pivotted about the axis of the pin 452 against the spring 454 so that the lever 450 escapes from the abutment surface 464.

The lever 450 and the collar 440 are then rotated about the axis of the access hole in the enclosure over an angular distance equal to the angular size of the gap between the projections 444 on the collar 440. The lever 450 then occupies the position shown in chain-dotted line in FIG. 5. In this position the projections on the front surface of the collar 440 bear against spacers 411 serving as abutments fixed to the rear surface of the flange 410 by screws 413. These spacers 411 thus define an indexing device for the collar 440.

The brushing device proper comprising the elements shown in FIGS. 2, 3 and 4 is then positioned on the fixing means 400.

To be more precise, the projections on the outside periphery of the flange 195 are inserted between the projections 444 on the collar 440, the front surface of the flange 195 resting against the O-ring 434.

The main axis A—A of the brushing device is then coaxial with the access hole in the enclosure.

The lever 450 is pivoted about the axis A—A back towards its original position.

During this rotation the projections 444 on the collar 440 take up positions behind the projections on the outside periphery of the flange 195.

At the end of its travel the lever 450 slides on the ramp 466 and comes to rest against the abutment surface 464.

The spring 454 holds the lever 450 in this position.

The collar 440 cannot pivot towards the position releasing the brushing device, corresponding to the position shown in chain-dotted outline for the lever 450 in FIG. 5.

The projections on the outside periphery of the flange 195 are then clamped between the rear surface of the auxiliary flange 430 and the front surface of the projections 444.

The brushing device is thus held firmly in position, the main axis A—A being coaxial with the axis of the access hole in the enclosure.

The brushing device is then ready to function.

During fitting of the casing of the brushing device to the fixing means 400, the casing 360 and the brush 301 carried by the latter are preferably retracted towards the rear.

To this end the piston 351 is put in a position adjacent the rib 184 in the actuator chamber 190.

To put the brushing device into service the motor 202 is started.

Rotation of the motor 202 rotates the hollow shaft 350 and the casing 360 about the main axis A—A through the intermediary of the epicyclic gear train 330 and rotates the brush 201 about the secondary axis B—B through the intermediary of the shaft 220, the splined shaft 230, the sleeve 250, the shaft 240 and the direction-changing device 260, 276.

The brush 201 is thus swept over a ring-shaped brushing surface centered on the main axis A—A and the radius of which is defined by the distance between the brush 201 and the main axis A—A.

A fluid under pressure is injected through one of the nozzles 194, 195 behind the piston 351 in the chamber 190 to move the hollow shaft 350 towards the front, that is to say towards the sealing plane to be brushed. The sleeve 250, the shaft 240, the toothed wheels 260 and 276, the shaft 270 and the brush 201 are also moved towards the front by virtue of the coupling in translation defined between the shaft 240 and the bearings 242, 244.

The brush 201 then comes to rest against the sealing surface to be brushed.

The force exerted by the brush on the sealing surface is defined by the force to which the spring 354 disposed between the hollow shaft 350 and the casing 360 is set.

At the end of the brushing operation a fluid under pressure is injected through the other nozzle 195 or 194 in front of the piston 351 to move the latter together with the hollow shaft 350 and the casing 360, through the intermediary of the abutment 356, towards the rear, that is to say away from the sealing plane to be brushed.

The motor 202 is then stopped.

To remove the brushing device it is merely necessary to move the lever 450 into the position shown in chain-dotted outline in FIG. 5 to release the projections on the outside periphery of the flange 195.

Then the centering flange 410, the auxiliary flange 430 and the collar 440 are withdrawn by unscrewing the nuts 422. The studs 420 are also removed.

During the brushing operation, suction means connected to the hole 144 provided in the front skirt 140 may be used to remove brushing residues.

Of course, the present invention is not limited to the embodiment that has just been described but encompasses all variations thereon within its scope.

Thus consideration could be given to rotating the mobile assembly and the brush by means of separate drive motors.

There is claimed:

1. Device for brushing the sealing plane of access holes in enclosures, comprising:

an assembly adapted to be rotated about a main axis coaxial in use with said hole, a mount at the end of said assembly, a brush on said mount eccentric to said main axis and adapted to be rotated about an axis transversely disposed relative to said main axis, and means for controlling the force with which said brush is applied to said sealing plane.

2. Brushing device according to claim 1, further comprising common drive motor means for rotating said assembly and said mount.

3. Brushing device according to claim 1, comprising an angle-changing device through which said brush is rotated.

4. Brushing device according to claim 1, wherein said drive motor means for rotating said assembly and said mount comprise pneumatic motors.

5. Brushing device according to claim 1, wherein said assembly comprises a hollow shaft adapted to rotate in use coaxially with the hole on the casing of the device and a central rotary shaft providing a rotational drive linkage between said drive means and said brush accommodated in said hollow shaft.

6. Brushing device according to claim 5, comprising an epicyclic gear train though which said hollow shaft is rotated by said drive means.

7. Brushing device according to claim 5, wherein said central shaft comprises two substantially coaxial members and a flexible coupling, optionally a bellows coupling, by which said members are coupled in rotation.

8. Brushing device according to claim 1, comprising a support shaft for said brush onto which said brush is screwed in the direction opposite to its direction of rotation.

9. Brushing device according to claim 1, wherein the direction of rotation of said assembly coaxially with said hole and the direction of rotation of said brush on said mount are determined so that relative displacement between said brush and said sealing plane to be brushed determined by rotation of said brush on said mount is directed in the same direction as relative displacement between said brush and said sealing plane to be brushed as determined by rotation of said assembly coaxially with said hole.

10. Brushing device according to claim 1, wherein said means controlling the force of application of said brush onto said sealing plane comprise spring means adapted to urge said mount towards said sealing plane.

11. Brushing device according to claim 10, wherein said assembly comprises two telescopic members adapted for relative sliding along the axis of said hole and coupled in rotation about said axis and spring means disposed between said telescopic members.

12. Brushing device according to claim 1, further comprising auxiliary drive means adapted to procure alternately movement of said mount towards said sealing plane to be brushed and movement of said mount away from said sealing plane.

13. Brushing device according to claim 12, wherein said assembly comprises two telescopic members adapted for relative sliding along the axis of the hole, moved relative to each other along said axis by said auxiliary drive means and coupled in rotation about said axis, one of said members being immobilized against movement in translation along the axis of said hole relative to said casing.

14. Brushing device according to claim 13, wherein said auxiliary drive means comprise a pneumatic actuator comprising a piston fastened to said other member and a housing fastened to said casing of the device.

15. Brushing device according to claim 1, comprising a casing accommodating said assembly, said mount and said means for controlling the force of application of said brush onto said sealing plane and further comprising a flange adapted to be fixed to said enclosure so as to receive and immobilize said casing so that the rotation axis of said assembly is coaxial in use with the axis of said hole.

16. Brushing device according to claim 15, comprising a bayonet type coupling whereby said casing is selectively attached to said flange.

17. Brushing device according to claim 15, wherein said flange is a centering flange adapted to be fixed to said enclosure, at the outside periphery of said sealing plane, by screwthreaded means and further comprising a locking collar mounted to rotate on said centering flange coaxially with said hole and adapted to be engaged with said casing.

18. Brushing device according to claim 17, comprising a lever and a cam on said centering plate, said collar being rotated by said lever in cooperation with said cam.

* * * * *